US005247822A

United States Patent [19]

Späth

[11] Patent Number: 5,247,822

[45] Date of Patent: Sep. 28, 1993

[54] METHOD AND DEVICE FOR MANUFACTURING FILLER ELEMENTS FROM EXPANDED MATERIAL

[76] Inventor: Max M. Späth, Postfach 151827, 8 München 15, Fed. Rep. of Germany

[21] Appl. No.: 455,359

[22] PCT Filed: May 16, 1989

[86] PCT No.: PCT/EP89/00535

§ 371 Date: Mar. 12, 1990

§ 102(e) Date: Mar. 12, 1990

[87] PCT Pub. No.: WO89/11357

PCT Pub. Date: Nov. 30, 1989

[30] Foreign Application Priority Data

May 17, 1988 [DE] Fed. Rep. of Germany ..... 3816792

[51] Int. Cl.[5] ..... B21D 35/00

[52] U.S. Cl. ..... 72/275; 72/282; 72/290; 72/356; 72/358; 29/6.1; 226/158

[58] Field of Search ..... 72/336–339, 72/275, 282, 278, 290, 358, 359, 356; 29/6.1, 6.2, 163.8; 226/158, 161, 162

[56] References Cited

U.S. PATENT DOCUMENTS

| | | | |
|---|---|---|---|
| 1,526,140 | 2/1925 | Gruver . | |
| 2,334,263 | 11/1943 | Hartwell | 29/163.8 |
| 2,784,453 | 3/1957 | Hjulian | 226/162 |
| 2,829,733 | 4/1958 | Bartels | 29/6.1 |
| 3,495,506 | 2/1970 | Plymale | 72/282 |
| 3,635,389 | 1/1972 | Shibata | 470/40 |
| 4,613,054 | 9/1986 | Schrenk | 72/275 |

FOREIGN PATENT DOCUMENTS

| | | | |
|---|---|---|---|
| 680737 | 8/1939 | Fed. Rep. of Germany . | |
| 23385 | 12/1948 | Finland | 226/162 |
| 2390223 | 12/1978 | France . | |
| WO8807013 | 9/1988 | PCT Int'l Appl. . | |

*Primary Examiner*—Daniel C. Crane
*Attorney, Agent, or Firm*—Dykema Gossett

[57] ABSTRACT

Containers of explosive liquids can be prevented from exploding by filling the containers with meshes made from metal foil which occupies a negligible fraction of the volume of the container although it must completely fill the container. In order to refill the containers, the rib mesh (1) must consist of sufficiently small, spherical bodies (24). The invention also deals with the production of these filling bodies (24) from aluminum strip expanded into a mesh. The aluminum strip is first passed through a calibration opening (4) which compacts it into a bar (2) of circular cross-section which is then compacted perpendicularly to its length and continuously transported in the longitudinal direction as it is being squeezed. The front piece of the bar is then detached and pressed in a mould with a hemispherical bottom (21) by a die with the same inner contour to form a spherical filling body.

12 Claims, 3 Drawing Sheets

METHOD AND DEVICE FOR MANUFACTURING FILLER ELEMENTS FROM EXPANDED MATERIAL

BACKGROUND OF THE INVENTION

1. Technical Field

The invention relates to a method for manufacturing filler elements from expanded material, as well as a device for implementing such method.

2. Background Art

Expanded material can be produced from any thin foil, usually made of metal, paper, wood, but also plastic, in which a large number of individual cuts are initially made, all running parallel to but offset in relation to each other; next the material is stretched transversely to the orientation of these cuts, thus producing a more or less two-dimensional lattice structure comprising, for example, rhomboidal openings and interlying webs of foil whose thickness corresponds to the spacing between the cuts.

Depending on the choice of material and also the selected thickness of the material, an expanded metal of this kind can be put to a wide number of uses: starting with very thin lattices, which can be used to Provide explosion protection in tanks, fire protection in general, and similar applications, the uses can range all the way up to the production of stair treads, catwalks, and the like, when sheet metal several mm thick is used.

One of the applications for expanded material, which is referred to hereafter exclusively as expanded metal, also consists of manufacturing filler elements of a certain size and shape by appropriately working the substantially two-dimensional lattice structure. These filler elements are then placed inside tanks containing explosive liquids. If such a container is ignited, the explosive gas accumulated in the free space of the container does not explode, but instead the contents of the container burn in a normal and controlled manner. Although to achieve this protection the containers must be completely filled with the filler elements, these filler elements possess such a large percentage of cavities that the holding capacity of the container for liquid materials is reduced by no more than about 1 percent to 6 percent when it is filled with filler elements.

In order to achieve this, it is obvious that the filler elements, in addition to being identical in size and shape, should also possess approximately the same density and thus foil massy because the explosion-preventing affect can only be reliably achieved, while simultaneously limiting the reduction in the container volume, if the metal foil is uniformly distributed within the filler elements and if, in turn, the filler elements are uniformly distributed in the container—this latter condition is determined by the uniform shaping of the filler elements. Therefore, a manufacturing method and also a device for carrying out this method are required so that the changes occurring in the expanded metal, when it is converted into filler elements, take place uniformly and in a defined manner, and consequently the filler elements which are produced not only exhibit the same external shape and dimensions, but also they possess approximately the same defined internal structure.

If, for example, one were merely to cut rectangular sections from the two-dimensional lattice-structure of the expanded metal and then crush these in a random manner until they assumed an approximately spherical outer shape, the following situation would always arise:

within the spherical outer contour, the material would be highly compressed at certain points, while at other points large cavities would remain. This would result in uneven heat transmission and would thus reduce the protective function. It has been found that filler elements having a spherical shape approx. 2 cm in diameter are suitable for subsequently filling automobile fuel tanks and small gasoline containers.

For the manufacture of these filler elements of expanded metal, procedures are known wherein at least in the final step, the ultimate shape of the filler element is generated by compressing the lattice work into a spherical shape between two halves of a mold which together form the desired spherical mold cavity. One of these mould sections might also be equipped with an ejector to push out the finished filler element. In order to achieve a uniform and defined distribution of the lattice work within the spherical shape of the finished filler element, however, it is necessary in particular to carry out certain processing steps ahead of the final shaping step.

SUMMARY OF THE INVENTION

It is therefore the task of the present invention to create a procedure for the manufacture of approximately spherical filler elements made of expanded metal; this procedure should be simple and reliable in operation and at the same time it should produce filler elements in which the lattice work is distributed in a uniform and defined manner within the filler element, which should also possess an outer contour which is as uniform as possible,; the filler elements should be produced from strip-shaped expanded metal.

In accordance with the present invention this task is solved by first drawing the strip-shaped expanded metal through a calibration opening, e.g. an opening having a cylindrical internal diameter and rounded inlet edges. As a result, the expanded metal strip is laterally compressed, i.e. transversely to its longitudinal axis and in the direction of the strip's width. Instead of rounded inlet edges, this calibration opening may also possess an inlet funnel which flares out to the full width of the metal strip, but at the inlet point it has a diameter corresponding preferentially to half the width of the strip, and it should be as long as the calibration opening. With this configuration, transverse undulations are formed in the strip and consequently the original width of the strip is compressed down to the diameter of the calibration opening; however, as a rule, this does not create a tubular structure with a cavity at the centre of the tube, and the density of the material increases only as a function of the smallest diameter of the calibration opening in relation to the width of the strip.

The expanded metal, which now possesses approximately the shape of an endless cylinder, is next further mechanically compressed and even crushed at various points transversely to Its longitudinal orientation, so that during this process the expanded metal is firmly gripped between clamping elements and cannot move relative to these clamping elements, not even longitudinally. This sausage structure, made of expanded metal, is then longitudinally transported in steps as follows: once the clamping elements have clamped the expanded metal they move the expanded metal, a certain distance in a longitudinal direction and then release it; the clamping elements then return to their starting position, so that the expanded metal can be compressed and clamped at the next point and then transported longitudinally once more.

By means of this longitudinal transportation process the expanded metal is forced through a second guide, similar to but narrower than the calibration opening; the sole purpose of this guide is to introduce the expanded metal into the mold arranged just behind the guide. Particularly when the expanded material is made from plastics, but also when it is made from metal, it is recommended that the calibration opening and the guide be heated to permit the expanded material to slide through more smoothly. This mold consists, for example, of a blind hole whose bottom is part of the negative mold for the filler element which is shaped in it, and its opening is aligned with the outlet from the guide. In this way, the end of the strand of expanded metal projects into the blind hole. This blind hole is formed by the approximately cylindrical mold, which is closable by a bottom section.

Next, the strand of expanded metal is separated by a knife at a point between the guide and the mold such that the separated section of the strand of expanded metal located between the cutting point and the bottom of the blind hole of the mold remains in the mould and is between 0.8 and 2.0 times as long as the diameter of the mold, the best result being achieved by a factor of 1.2. Next, this mold is moved out of alignment with the guide in order to permit, for example, a hemispherical die to act on the mold. The circumference of this die fits precisely in the blind hole, and its face forms the second part of the negative mold, complementing the bottom of the blind hole, and thus defining the outer contour of the filler element. If the filler elements are to be spherical in shape, both the face of the die and also the bottom of the blind hole each have an approximately hemispherical contour, and both the calibration opening and the guide have a round cross section which, regardless of the rounding of the inlet edges, can either remain constant or may taper conically. It is, of course, advantageous to design the calibration opening and the guide, as well as the mold and its bottom section, as replaceable units in order to select another shape or dimension of the filler elements or of the intermediate products.

It can be seen from this sequence of procedures that all the influences acting on the expanded metal, i.e. the individual processing steps which have been described, from the transverse compression in the calibration opening, the discontinuous compression at certain intervals, through to the compression of the section of strand into a spherical shape, all take place in a defined manner and thus a defined result is achieved as regards the resulting density and distribution of the material in the interior of the filler elements.

Another advantage of the process is that it can be designed, with an appropriate device, to run as a continuously operating process, although individual processing steps, namely the compressing and cutting at certain intervals and the compacting of the material into a spherical shape, will take place discontinuously.

Such a process, in an appropriately designed device, would be used as follows: the expanded metal is supplied in the form of a two-dimensional lattice-structured strip. It can be supplied from a roll, or it can also be taken directly from a device for manufacturing the strip-shaped expanded metal and then fed into the device for manufacturing filler elements.

An already described, this strip-shaped expanded metal is first drawn through a calibration opening consisting of a throat of circular cross section and having rounded inlet edges, which is formed in a thick plate of metal or a similarly hard material. The cross section may be reduced in the longitudinal direction of the opening so that the opening is conical in shape, or it may remain of constant cross section so that the opening is substantially cylindrical in shape. The axial length of this calibration opening should be at least twice as large as its diameter. As a result, the strip-shaped expanded metal is compressed and folded transversely to its longitudinal direction, so that a strand is formed having a cross section corresponding approximately to the cross section at the end of the calibration opening. This strand must now be further compacted and crushed transversely to the longitudinal direction at certain intervals. This is achieved by arranging two plates, one immediately behind the other, downstream of the calibration opening and oriented transversely to the longitudinal direction; each of these plates possesses an identical, approximately pear-shaped opening. However, these openings in the two plates are inverted in relation to each other and they only partially overlap, so that the longitudinal axes of the pear shapes run parallel in the two plates, but although the two thick ends of the two pear shapes are congruent, the two thin ends point in opposite directions. These openings must be dimensioned in such a manner that when the thick ends of the two pear-shaped openings overlap, a free gap is created, and this gap is larger than the cross section of the strand of expanded metal emerging from the calibration opening which must always run through the free gap in the two plates.

If, now, the two plates are displaced relative to each other along the longitudinal axis of the pear-shaped openings, but in opposite directions, i.e. in each case in the direction of the thin end of the pear-shaped opening of the other plate, this causes a continuous narrowing of the free gap through the two plates, similar to the manner in which the mechanical shutter of a camera closes. In this way, the strand running through the free gap in the two plates is further compressed transversely to its longitudinal direction and finally it is crushed between the two plates. Once this stage is reached, the two plates are advanced together by a certain amount in the longitudinal direction of the strand, and the entire strand of expanded metal, which is clamped between the two plates, is advanced by the same amount in the longitudinal direction. Next, the clamping of the strand is released by the relative motion of the two plates and the free gap is enlarged once more to its original size; the two plates are moved back together along the longitudinal direction of the strand to their original position to commence the next cycle of compressing and clamping of the strand. By means of this clamping, the expanded metal is not only further compacted to the desired amount transversely to its longitudinal direction, but the transverse folding of the original strip of expanded metal, which took place in the calibration opening, is finally fixed by the crushing action. This means that the distribution of the material in the transverse direction of the strand is rendered practically irreversible so that any renewed distribution could only be achieved by the precise application of mechanical force. At the same time, through this transverse compaction at certain points on the strand, the entire cross section of the strand is also reduced because the compaction takes place not just at one particular axial point on the strand, but in fact a continuous transition in cross section occurs in a certain area ahead of and behind this axial point on the strand. Since the distance between the clamping points in the axial direction of the strand is smaller than the zone in which the cross section of the strand is affected, the entire strand is constricted, although to a varying extent, in this work step. Through longitudinal transportation, this further compacted strand is then introduced into a guide of round cross section corresponding in shape to the calibration opening, although it is smaller in cross section, in keeping with the reduced cross section of the strand. This guide serves to introduce the strand into the mold which follows immediately after it; the mold consists of a blind hole arranged in a metal element, and the open end of this blind hole is oriented towards the outlet end of the guide. The bottom of the blind hole forms part of the contour required to shape the filler element. The length of the blind hole should be selected in such a manner that the portion of the strand contained in it, assuming that the strand is inserted right down to the bottom of the blind hole, corresponds to precisely the amount of extended metal required in the finished filler element.

Once the strand of expanded metal has been passed through the guide into the blind hole, right down to the bottom of the blind hole, the strand is severed by means of an intermediate guide and a knife arranged in front of it.

Next, the mold containing the severed section of strand is moved away from its position behind the guide in order to introduce a die into the blind bole; the external circumference of this die and the internal circumference of the blind hole are perfectly matched and the face of the die, together with the bottom of the blind hole, forms the contour of the filler element. If the intention is to produce spherical filler elements, then both the bottom of the blind hole and the face of the die possess a concave, approximately hemispherical shape so that when the die is fully inserted into the blind hole a spherical cavity is created, into which the section of expanded metal strand is compressed, thereby forming a spherical filler element.

Moving the mold out of alignment with the guide takes place as follows: Instead of a single mold being arranged behind the guide, a mold turret is fitted containing several molds arranged in a radial array, and their blind holes are accessible from the outside. The mold turret is arranged in such a way that its axis of rotation runs transverse to the longitudinal axis of the guide and intersects with the latter axis so that by rotating the mold turret the individual molds can each be brought into alignment just behind the outlet from the guide.

When a severed section of strand is contained in a mold positioned, for a moment, directly behind the guide, the mold turret is rotated onwards by one position, i.e. until the next mold is located directly behind the guide outlet. In this way, the mold containing the severed section of strand is also further rotated and should then be lined up with a die which then acts on the mold. By rotating the mould turret in steps, the opening of the blind hole points increasingly downwards until the finished filler element contained in the mold drops out of the mold and into a collecting container.

If this fails to happen, because the filler element is jammed or stuck in the mold, the filler element must be pushed out of the mold by an ejector. This can be accomplished because the bottom of the blind hole is not formed in one piece with the walls of the hole but can be moved relative to the walls of the hole, i.e. axially within the mold, by means of a plunger. By displacing the moveable bottom of the blind hole towards the opening of the hole, the filler element can be forced out of the mold.

For this purpose, the mold turret should preferentially carry an even number of molds and should be designed in such a way that the bottoms of opposing molds are mechanically linked and can be displaced a certain distance in the axial direction of the blind holes. In this way, when the die is pressed into the mold which in currently aligned with it, the bottom of the blind hole of this mold is moved towards the center point of the mold turret, and this action displaces the bottom of the blind hole of the opposite mold away from the center point, i.e. from the axis of the rotation of the mold turret, and towards the opening of the blind hole. In the process, any filler element still present in this mold is ejected. For this purpose, each of the bottoms of the blind holes should be spring-loaded towards the center of the mold turret so that when the die is withdrawn from the mold, both mold bottoms return to their original positions, namely centrally located between the two blind hole openings.

Of course, a device of this type can process a number of expanded metal strips in parallel, which would mean that a corresponding number of calibration openings and guides would have to be arranged alongside each other in metal tracks, and also the two plates which are arranged immediately one behind the other would have to contain a corresponding number of pear-shaped openings. For the mold turret, this would mean that several turrets, arranged one behind the other in the axial direction of the mold turret, would be combined into a kind of roll in which a series of molds is positioned at appropriate radial angles, and naturally, a corresponding number of dies would interact with the molds in a certain position.

BRIEF DESCRIPTION OF THE DRAWINGS

A preferred embodiment of the device according to the invention will now be described in further detail on the basis of the accompanying drawings which show the following.

DETAILED DESCRIPTION OF THE PREFERRED EMBODIMENTS

Figure 1:
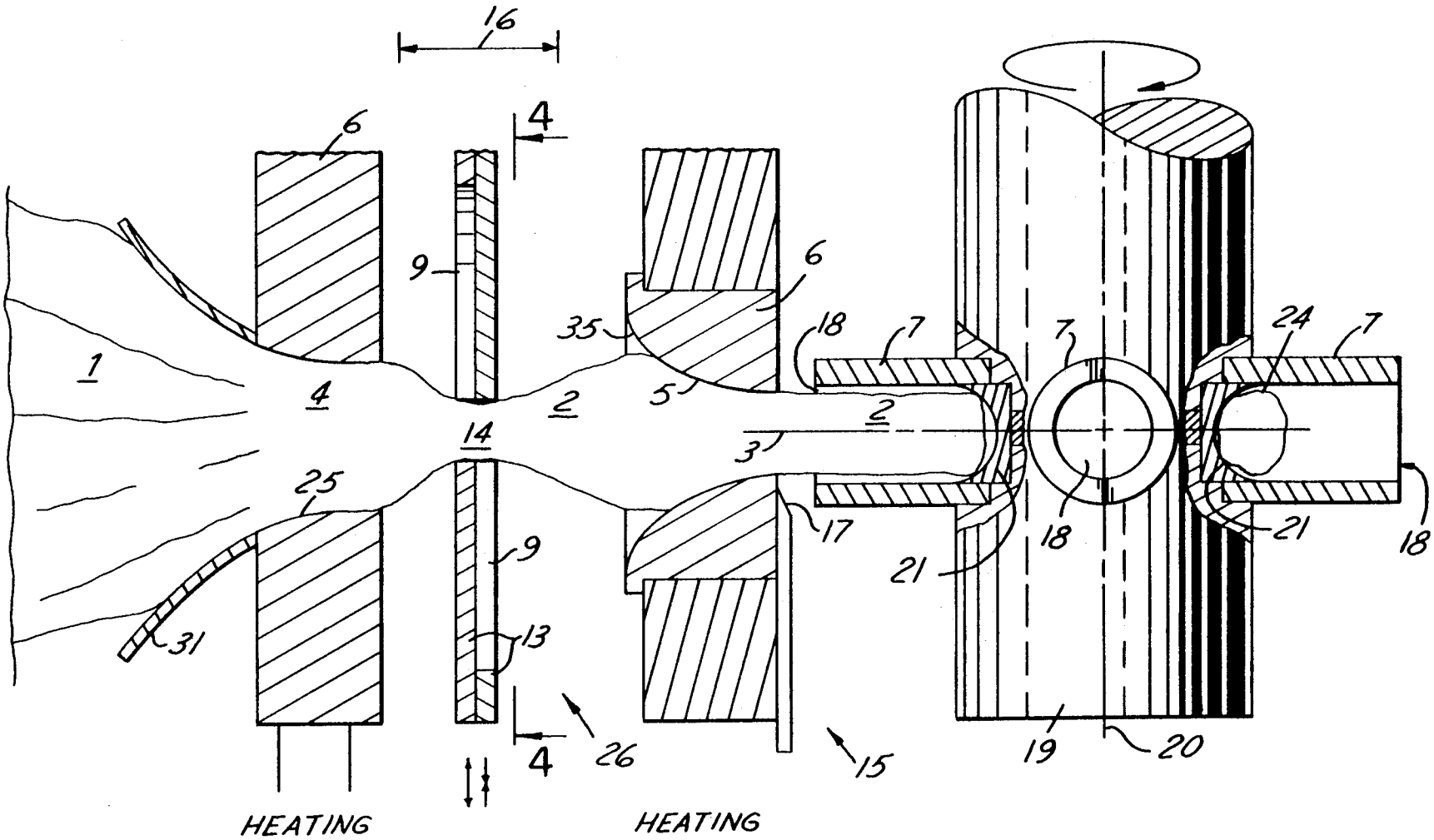
FIG. 1: A top view of a device according to the invention showing the principle of operation.
Figure 2:
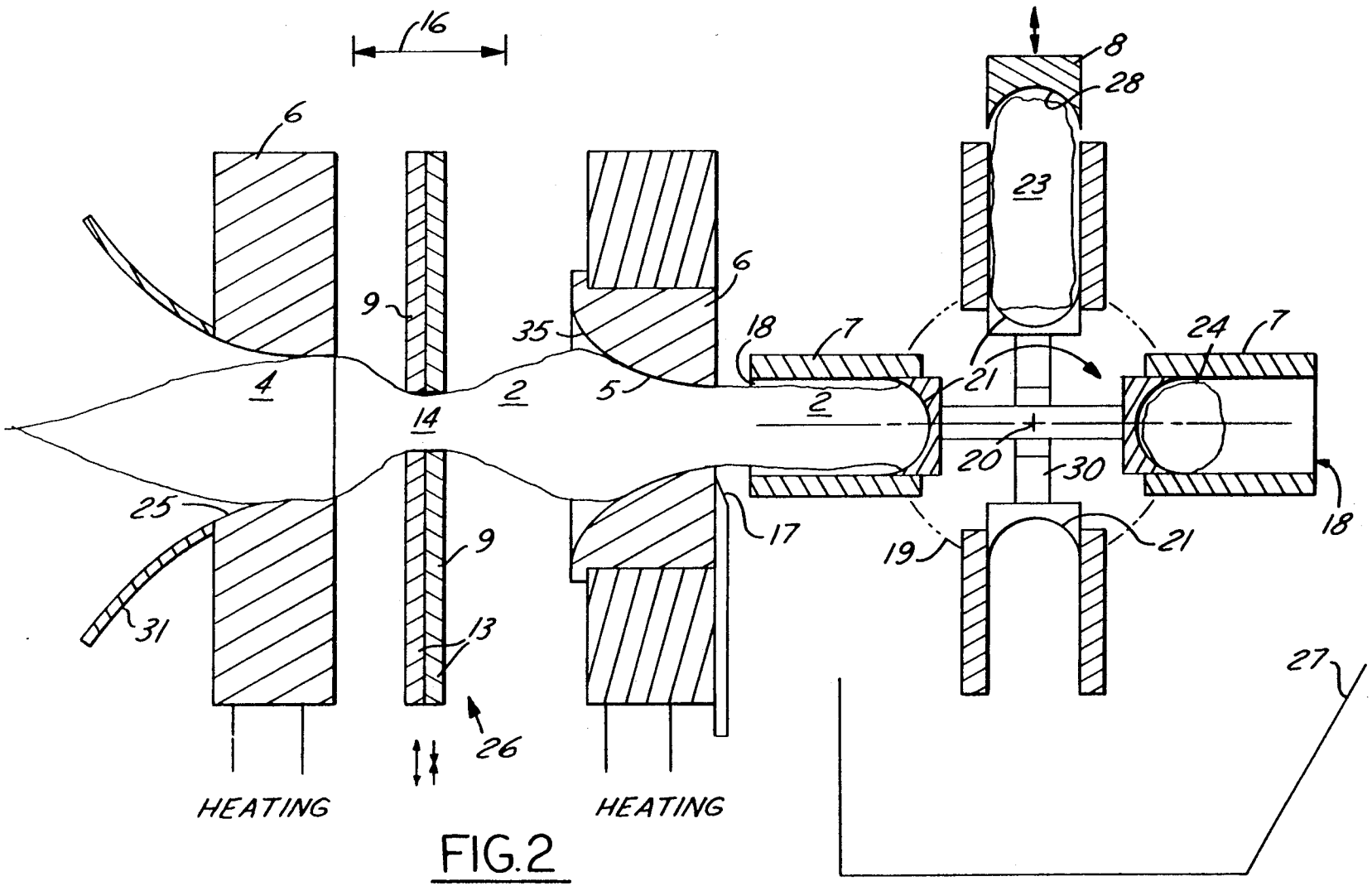
FIG. 2: A side view of the device.

FIG. 1 shows, in top view, the complete device for manufacturing spherical filler elements from strip-shaped expanded metal, while FIG. 2 shows the same installation in side view.

In both cases, the strip consisting of expanded metal runs from the left and first enters a calibration opening 4. This calibration opening 4 has the shape more or less of a funnel of approximately circular cross section and possessing a greatly rounded inlet edge 25 on the inlet side of the strip 1. In FIGS. 1 and 2, this calibration opening 4—apart from the rounding of the inlet edge 25—is shown as being cylindrical while in FIG. 6 the special design with a tapering cross section, i.e. in the form of a truncated cone with rounded inlet edges, is shown. By drawing the initially substantially two-dimensional strip 1 through this calibration opening 4, the strip is compressed and caused to fold transversely to its longitudinal direction 3, thus becoming compressed Into a strand 2 having an approximately circular outer contour.

Figure 4:
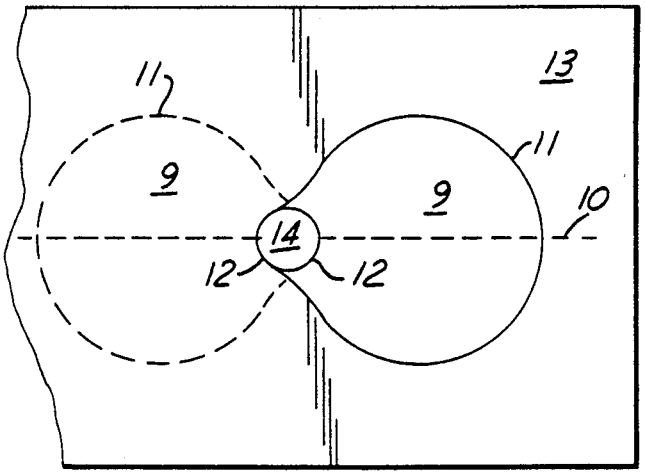
FIG. 4: A view of the two plates, arranged one behind the other, in the axial longitudinal direction.
Figure 5:
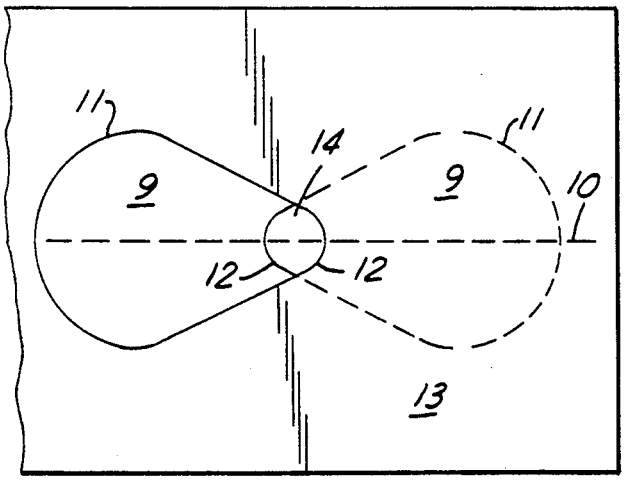
FIG. 5: A view as shown in FIG. 4, but with differently shaped openings in the plates.

A longitudinal transportation mechanism 26, which at the same time further reduces the cross section of the strand 2, not uniformly over the entire length of the strand 2 but at individual points on the strand, is arranged following the calibration opening. This longitudinal transportation device 26 consists of two plates 13 arranged together parallel to each other and transversely to the longitudinal direction 3. Each of these plates possesses an opening 9 having a pear-shaped contour as shown in FIGS. 4 and 5. These pear-shaped openings 9 thus possess on the one hand a thick end 11 and on the other hand a thin end 12. The two plates 13 are displaceable parallel to each other and again transversely to the longitudinal direction 3 of the strand 2, and the pear-shaped openings 9 are arranged in such a way in the plates 13 that the axis of symmetry 10 of the pear-shaped openings 9 runs parallel to the direction of motion of the plates 13. In addition, for example, the thin ends 12 of the openings 9 in the two adjacent plates each point in opposite directions. Thus, the two openings 9 can never be fully congruent, but the maximum possible gap width 14 through the plates 13 can be achieved by bringing the two thick ends 11 of the pear-shaped openings 9 into congruent alignment. This maximum gap width 14 must be at least as large as the cross section of the strand 2 after it emerges from the heatable calibration opening 4, because it must run through this maximum gap width 14 in the plates 13 into the guide 5.

In a fixed cycle, the two plates 13 are displaced parallel to each other until, instead of the thick ends 11, only the thin ends 12 of the openings 9 are aligned with each other, thus greatly reducing the free gap 14 through the plates 13. As a result, the cross section of the strand 2 is greatly reduced and the strand 2 is not only compressed but actually crushed between the two plates 13 and thus held firm.

While the plates 13 are in this relative position, they are moved together with the clamped strand 2 by a certain amount of stroke 16 in the longitudinal direction 3 of the strand 2, so that the entire strand 2 and the strip 1 ahead of the calibration opening 4 is moved by the amount of the stroke 16 towards and into the guide 5. Once they have executed the stroke 16, the two plates 13 are moved relative to each other so that the two thick ends 11 of the openings 9 come into alignment, thereby creating the maximum possible gap width 14 and the plates 13 can be moved back along the strand 2 by the amount of stroke 16. They are then in a position to compress the strand 2 once more at a new point and to hold it fast in order to advance it by the amount of stroke 16 during the next transportation step.

The constriction of the strand 2 which occurs at various points during this working step is so extensive that the stroke 16, which is at the same time the distance between the constriction points on the strand 2, is inadequate to maintain the original cross section of the strand 2 exiting from the calibration opening 4, at the points in the middle between the constriction points. Or, to express this another way, the distance and the stroke 16 between the constriction points an the strand 2 are so small that by constricting the strand 2 at various points, the cross section is reduced practically over the entire length of the strand.

Figure 3:
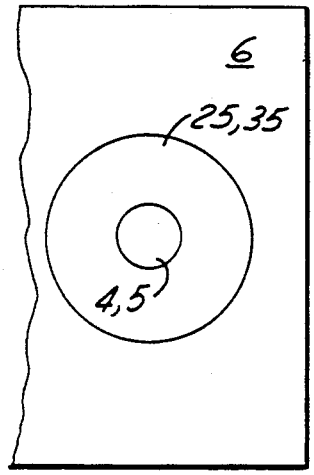
FIG. 3: A view a calibration opening or of a guide seen in the axial direction.
Figure 6:
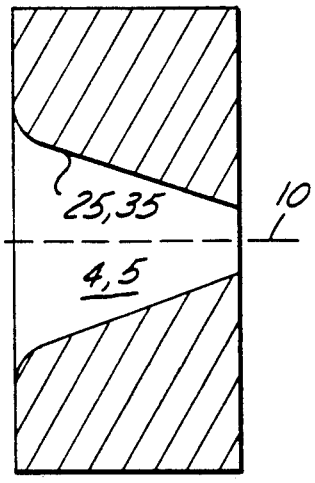
FIG. 6: A cross sectional view through a calibration opening or a guide having a different shape from that shown in FIGS. 1 and 2.

For this reason, the guide 5, which consists substantially of a tubular section 6 of circular internal diameter with a bevelled, rounded inlet edge 35, is somewhat smaller than the calibration opening 4, but otherwise it is very similar in configuration to the latter (see FIGS. 3 and 6). Furthermore, it should be noted both in the case of the calibration opening 4 and also in that of the guide 5, that the axial length both of the calibration opening 4 and of the guide 5, even after subtracting the rounded section of the inlet edge, corresponds at least to the diameter of the outlet at the end of the calibration opening 4 or guide 5.

The function of the guide 5 is to introduce the strand 2 into the mold 7 located just behind the guide. This mold, together with its bottom 21, which forms one half of the negative mold for producing the filler element 24, has the form of a blind hole 18. The walls of the blind hole 18 serve later to guide a die 8 which is inserted between the walls of the blind hole 18 towards the bottom 21 of the hole, and the concave face 28 of the die forms the other half of the outer contour of the finished filler element 24.

In order to compress a defined amount of expanded metal in the mold 7 to produce a filler element 24, the strand 2 is at first introduced into the mold all the way down to the bottom 21 of blind hole 18 and then it is severed by means of a cutting device 15 positioned between tubular section 6 forming the guide 5 and the mold 7. This cutting device 15 consists of a knife 17 which shears the strand 2 against the outlet edge of the tubular section 6 forming the guide 5. Once the cutting is completed, a defined section 23 of the strand 2 is left in the mold 7 which is then rotated out of its aligned position relative to the guide 5 in order to permit the die 8 to act on this section 23 of expanded metal, thereby shaping it into a spherical filler element 24.

This change in position of the mold 7 is accomplished by having several molds 7 radially arranged in a mold turret so that the free opening of their blind holes 18 points radially outwards. The axis of the rotation 20 of the mold turret 19 is oriented transversely to the longitudinal direction 3 of the strand 2 and the entire arrangement and configuration of the mold turret 19 is selected in such a manner that by rotating the mold turret 19, the molds 7 are on the one hand brought into alignment with the guide 5 and on the other hand can be aligned with the die 8.

Therefore, once the strand 2 has been severed, a mold 7 containing the severed section 23, can be rotated around the axis of rotation 20 of the mold turret 19 in such a way that it is brought into alignment with the die 8, which is inserted between the walls of the blind hole 18 and shapes the section 23 into a sphere between its concave face 28 and the similarly concave bottom 21 of the blind hole 18.

When this process is repeated in the next mold 7, the preceding mould 7 containing the finished filler element 24 is also rotated by one further position and, in the embodiment comprising four molds 7 mounted in a turret 19 as illustrated in FIG. 2, it is then located in a horizontal position opposite guide 5. As the mold rotates further into the lower position on the turret 19, the filler element 24 drops down into a collecting container 27. If this does not happen, then the filler element 24 must be forced out of the mold 7.

This latter action can be accomplished by making the bottom 21 of the blind hole 18 movable in the axial direction of the blind hole 18. In addition, given an even number of molds 7 mounted in a turret 19, as is the case illustrated here, the bottoms 21 of two opposite molds are mechanically rigidly linked with each other via a plunger 30. As soon as the bottom 21 is moved towards the axis of rotation 20 of the mold turret 19, the opposite bottom 21 moves away from that axis. In this way, when the die 8 is inserted into the upper mold 7 in the mould turret 19 illustrated in FIG. 2, the corresponding bottom 21 in this upper mold is displaced slightly in the direction of the axis of rotation 20, and the opposite bottom 21 in the lower mold 7 forces out any filler element 24 that may still be present in this mold.

Of course, this coupling of the two opposing bottoms 21 within the same radial planes of the mold turret 19 must be mechanically facilitated by providing appropriate opposite recesses in the respective plungers 30 as illustrated in FIG. 2. Similarly, springs or other devices must be provided so that, after the opposing mold bottoms 21 have been displaced in this way from their normal starting position, they can be returned again to that position. This could be accomplished, for example, by spring-loading the bottoms against a stop positioned in the center of the mold turret 19.

FIG. 3 shows a frontal view of the calibration opening 4 looking in the longitudinal direction 3. This Figure could equally well be a corresponding view of the guide 5. In both oases it is possible to identify, on the one band, the free inner diameter and also, on the other hand, the rounded inlet edge 25 or 35 which is depicted as an annular zone.

FIGS. 4 and 5 show the mutual overlapping of the openings 9 in the plates 13, which are arranged one behind the other, again looking in the longitudinal direction 3. In FIG. 5 the connecting line between the thick end 11 and the thin end 12 of the pear-shaped opening 9 is more or less straight, while in FIG. 4 a curved transition has been selected. In both cases, the two openings 9 are shown with only the thin ends 12 overlapping and thus only a small free gap 14 is available for the strand 2 which is positioned in that gap during the processing of the material. The contour of the opening 9 in the plate 13, which is positioned behind the front plate and cannot be seen here, is indicated by a dashed line.

FIG. 6 also illustrates the possibility of selecting a conical configuration not only for the calibration opening 4 but also for the guide 5, regardless of the fact that in both cases the inlet edge 25 or 35 must be rounded.

As is further evident from FIGS. 1 and 2, the tubular sections 6, forming the calibration opening 4 as well as the guide 5, are replaceable. The same applies also to the molds 7 with the associated bottom sections 21. This not only makes it easy to replace the parts if they become worn, but also it is a simple matter to convert the device if other shapes or dimensions of the filler elements or the intermediate products are desired.

Similarly, it can be seen from FIGS. 1 and 2 that the calibration opening 4 and the guide 5 may be formed either by a one-piece component of correspondingly large axial length, as here in the case of guide 5, or also they may be made of more than one part, for example a solid component forming the smallest cross section as in the case of calibration opening 4, as well as an inlet funnel 31 made of thinner material and positioned ahead of the more solid component.

I claim:

1. A method for producing filler elements from strip-shaped material, characterized by the steps of:

a) compressing a strip made of expanded material transversely to its longitudinal direction to form a strand of approximately round cross section which passes through a calibration opening, b) after passing through this opening, the strand being mechanically further compressed at intervals transversely to its longitudinal direction and then further transported discontinuously in the longitudinal direction into and through a guide of round cross section until the front part of the strand projects into a mold, c) severing the strand at a point between the guide and the mold, d) the severed section of the strand remaining in the mold and being compressed by a die which is introduced into the mold to form the desired filler element, e) disposing a mold turret immediately following the cutting device consisting of an even number of radially arranged molds, wherein the axis of rotation of the mold turret runs transversely to the longitudinal direction of the strand, f) each mold possessing a blind hole which can align with the guide and is open towards the latter, g) the bottom of the blind hole being movable in the axial direction of the blind hole, and in each case two bottom sections of oppositely arranged molds in the turret being connected together, and h) a die, which fits exactly into the blind hole and is aligned with the blind hole of the mold which is positioned on the mold turret alongside the mold which is at that moment in alignment with the guide.

2. A device for producing filler elements from strip-shaped expanded material, characterized by the fact that the following assemblies are arranged in the following sequence along a direction of travel of the expanded material for each strip being processed:

a) a calibration opening of approximately round cross section, and having a funnel-shaped inlet with round inlet edges b) a longitudinal transportation device consisting of two plates arranged one immediately adjacent the other along the direction of travel and oriented transversely to the longitudinal direction of the strand, and containing openings so that when the two plates are moved in a parallel direction relative to each other a free gap through the plates is reduced and the strand is clamped and further reduced in cross section, so that in this clamped state the strand is transported in a longitudinal direction by moving the plates by a certain amount of stroke in that same longitudinal direction c) a guide, consisting of a tubular section of circular internal diameter d) a cutting device immediately at the end of the guide, consisting of a knife, which shears the strand at the end of the tubular section, e) a mold turret immediately following the cutting device, consisting of an even number of radially arranged molds, wherein the axis of rotation of the mold turret runs transversely to the longitudinal direction of the strand, f) each mold possessing a blind hole which can align with the guide and is open towards the latter, g) the bottom of the blind hole being movable in the axial direction of the blind hole, and in each case two bottom sections of oppositely arranged molds in the turret are connected together, and h) a die, which fits exactly into the blind hole and is aligned with the blind hole of the mold which is positioned on the mold turret alongside the mold which is at that moment in alignment with the guide.

3. A device according to claim 2, characterized by the fact that the inlet edges of the guide are funnel-shaped and rounded.

4. A device according to claim 2, characterized by the fact that the smallest diameter of the calibration opening is ¼ to 1/10 the width of the strip.

5. A device according to claim 2, characterized by the fact that the openings in the plates are pear-shaped, with their longitudinal axes oriented in the direction of motion of the plates and having a diameter at the thicker end of the opening which corresponds at least to the diameter of the calibration opening.

6. A device according to claim 4, characterized by the fact that two plates are movable parallel and relative to each other, along the axis of symmetry of the openings and out of the position in which the thick ends of the two openings form the free gap, so that the free gap is formed only by the overlapping of the two thin ends of the pear-shaped openings.

7. A device according to claim 2, characterized by the fact that the stroke is equal to one to three times the diameter of the filler elements.

8. A device according to claim 2, characterized by the fact that the length of the section of the strand is 0.8 to 2.0 and in particular 1.2 times the diameter of the filler element.

9. A device according to claim 2, characterized by the fact that the bottom of the mold and the face of the die each possess an approximately concave hemispherical shape.

10. A device according to claim 2, characterized by the fact that at least one of the calibration opening and the guide is conically tapered.

11. A device according to claim 2, characterized by the fact that the tubular sections in which the calibration opening or the guide are located, can be heated.

12. A device according to claim 2, characterized by the fact that at least one of the tubular sections in which are located the calibration opening, the guide, the mold, and the die can be replaced by components having different internal contours or internal dimensions.

* * * * *